United States Patent [19]

Rigby

[11] Patent Number: 4,620,341

[45] Date of Patent: Nov. 4, 1986

[54] CURB AND GUTTER MACHINE

[76] Inventor: Robert B. Rigby, P.O. Box 83, Nokomis, Fla. 33555-0083

[21] Appl. No.: 740,342

[22] Filed: Jun. 3, 1985

[51] Int. Cl.[4] ..... E01H 1/08; E01H 1/04

[52] U.S. Cl. ..... 15/339; 15/4; 15/340; 15/366; 56/12.7

[58] Field of Search ..... 15/340, 4, 339, 366; 56/12.7, 13.3, 13.4, 202, DIG. 8, 14.5

[56] References Cited

U.S. PATENT DOCUMENTS

| | | | |
|---|---|---|---|
| 2,270,646 | 1/1942 | Campbell | 56/14.5 X |
| 3,183,653 | 5/1965 | Cromwell | 56/12.7 |
| 3,189,932 | 6/1965 | Daneman | 15/340 |
| 3,506,998 | 4/1970 | Perry | 15/340 X |
| 3,778,857 | 12/1973 | Hughes | 15/4 |
| 3,778,865 | 12/1973 | Schmidt et al. | 15/340 |
| 4,250,695 | 2/1981 | Comer et al. | 56/12.7 |
| 4,398,394 | 8/1983 | Klinner | 56/14.5 |

*Primary Examiner*—Chris K. Moore
*Attorney, Agent, or Firm*—Pettis & McDonald

[57] ABSTRACT

A new curb and gutter machine used in combination with a vehicle and characterized by its construction to include an adjustable cutter for trimming along the side of a roadway or curb, a sweeper for removing not only trimmed material but also other debris which might be along the side of the roadway, and a vacuum head for transferring the debris into a receptacle that is preferably mounted at the rear of the vehicle. The machine of this invention is further characterized by its utilization of braided cable to accomplish both the cutting operation and the sweeping operation, thereby significantly increasing the useful life of both the cutter and the sweeper.

13 Claims, 4 Drawing Figures

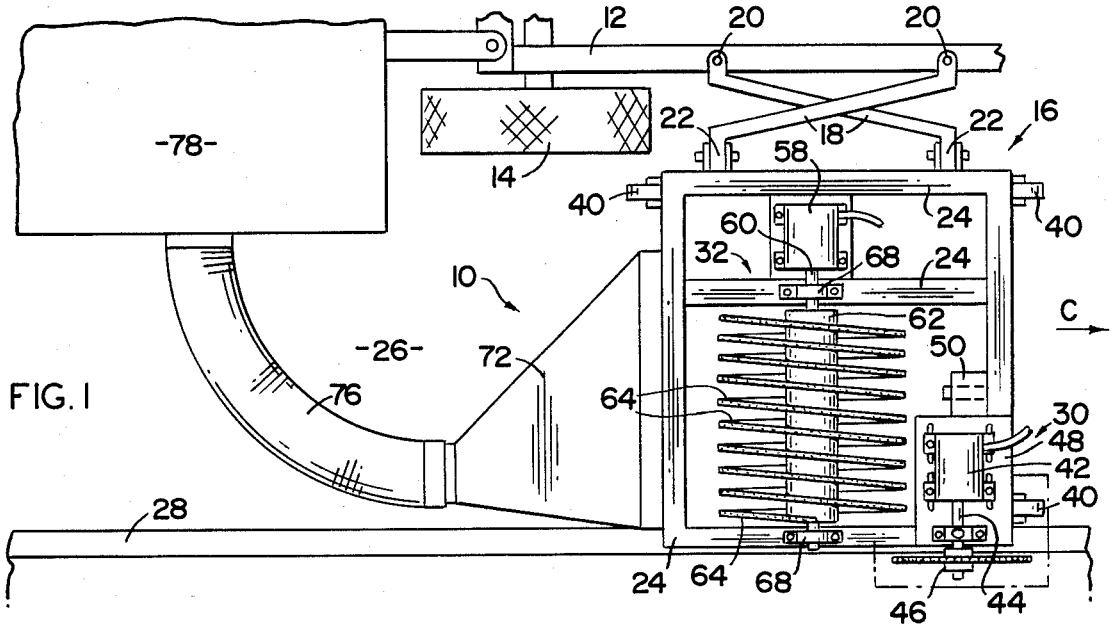
FIG. 1
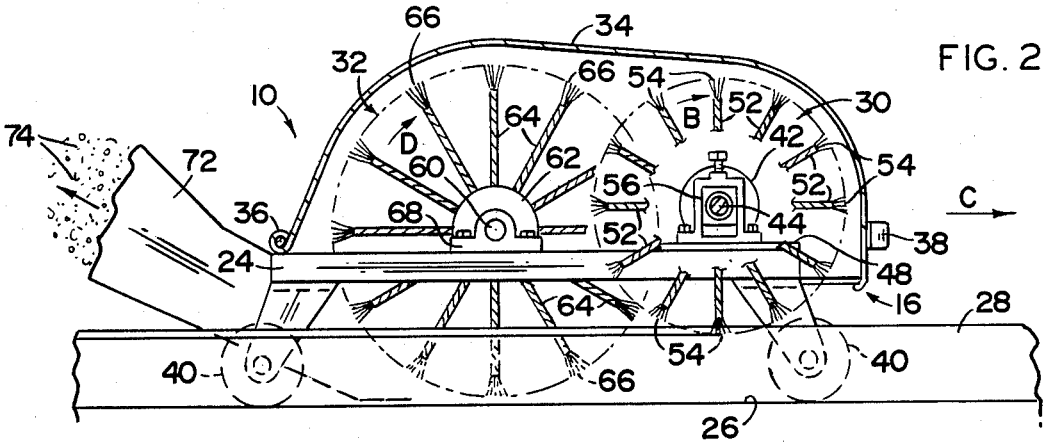
FIG. 2
FIG. 3
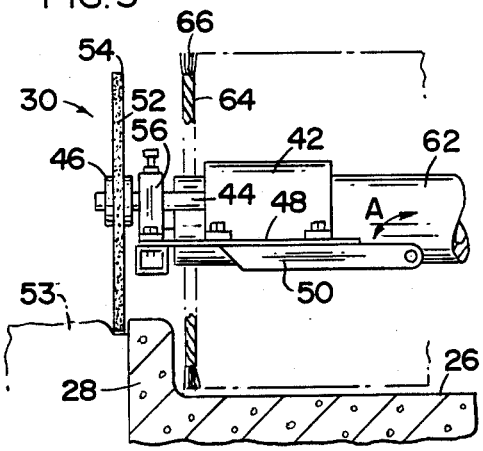
FIG. 4
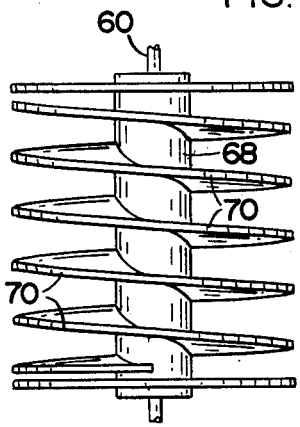

CURB AND GUTTER MACHINE

BACKGROUND OF THE INVENTION

1. Field of the Invention

The present invention relates to a curb and gutter machine used in combination with a vehicle for trimming the edge of roadways, including curbs of various configuration, for sweeping trimmed material and other trash or debris from the side of the roadway, and for transferring the loose debris into a collection means for ultimate disposal. Thus, one might properly characterized this invention as falling within the broad field of street sweepers.

2. Description of the Prior Art

Street sweepers and vacuuming devices are well known in the prior art, and virtually all such sweeping devices use a brush, or a series of brushes, for removing debris from the side of a road or street. While many such prior art devices are self-powered, a number of attachment devices for vehicles are also taught. It is also known in the prior art to utilize a vacuum-type device for picking up trash from a street's surface or curb and for transferring the trash into a receptacle for transportation to a disposal facility. Some prior art devices also disclose the utilization of a water spray in combination with the sweeping and vacuuming apparatus whereby at least portions of the road surface are, to some extent, washed.

One of the oldest examples of a street sweeping machine is presented in U.S. Pat. No. 1,043,533 to Nolan. That patent teaches the use of a brush in combination with a conveyer mechanism for removing dirt from a roadway and transferring that dirt into a receptacle formed within the machine. What might be considered as exemplary of "standard" self-powered street sweeping equipment is disclosed in U.S. Pat. No. 3,113,332 to Kasper. A street sweeping attachment which can be mounted on the front end of a vehicle is disclosed in U.S. Pat. No. 2,101,769 to Westmoreland. As is immediately apparent upon reviewing each of these three patents, all accomplish their sweeping utility by rotating a brush member against the surface of the roadway to be swept.

U.S. Pat. No. 1,701,996 to Dansby discloses a suction cleaner apparatus which is attachable to and driven by an ordinary tractor or similar vehicle. According to the disclosure of Dansby, his suction cleaning apparatus is useful in cleaning and removing refuse and debris on a large scale. The attachment also includes a receptacle for removed debris.

This, while the prior art clearly discloses means for sweeping debris from a road and for removing the swept debris by vacuum means, there appears to be no teaching or suggestion of any means whereby the side of the road, or the curb, may also be trimmed as the street is swept. Furthermore, the actual sweeping implement of the prior art devices is generally described as being of a bristle brush construction. Obviously, utilizing such brushes for the sweeping of streets subjects those bristles to intense wear, requiring frequent adjustment of the brush so that trash is effeciently removed, and also requiring frequent replacement of the brush heads as they become unusable from wear.

It is therefore clear that there is a great need in the art for an attachment which will not only sweep up and remove debris from a road surface, but will also include means for trimming or edging the side of the road and any curb placed therealong. In recognition of wear problems associated with art devices, it is also clear that a need exists for a curb trimming and gutter sweeping machine that utilizes cutting elements and sweeping elements of great durability.

SUMMARY OF THE INVENTION

The present invention relates to a curb and gutter machine used in combination with a vehicle such as, for example, a tractor. The curb and gutter machine of this invention is useful for trimming the edge, or curb of a street, for sweeping up the trimmed material and other debris lying along the street edge, and for removing the debris and placing it into a receptacle for ultimate disposal. As will be described in greater detail below, the machine of this invention includes an adjustable cutter means so that edges and curbs of various configurations may be trimmed. The machine further comprises a unique construction whereby the cutting head and the brush head of the sweeper means are both preferably fabricated from braided steel cable.

The curb and gutter machine basically comprises a housing assembly which is attachable to the vehicle frame. In normal operation, the housing assembly would be attached along the right side of the vehicle and toward the front of the vehicle so as to be positioned for use in the normal flow of traffic. Of course, the machine of this invention could just as easily be mounted on the left side of its vehicle. The housing assembly is attached to the vehicle by mounting arms which are movable so as to permit horizontal adjustment of the machine with respect to the supporting surface, or road, along which the vehicle is traveling. The housing assembly further comprises a shroud cover disposed in substantially enclosing, and therefore protecting, relationship to the cutter means and the sweeper means. The housing assembly further comprises a plurality of ground wheels attached thereto around the bottom of the shroud cover so that the machine may roll along the street surface.

Mounted within the shroud cover, and attached to the housing assembly's frame structure is the cutter means of this invention. The cutter means comprises a motor having a driven shaft extending therefrom, and the cutting head is attached to that shaft. Though not limited thereto, a preferred motor means for this invention is a hydraulic motor, fluid reservoirs for which are mounted on the vehicle and connected to the motor means by standard hydraulic lines. The cutting head comprises a plurality of cutting elements formed by substantially equal lengths of braided steel cable extending radially from the axis of the driven shaft. Thus, upon energizing the cutter motor, the shaft will rotate and the trimming operation is accomplished by the action of the free end of each of the braided steel cables.

As indicated above, the cutter means is movably attached to the housing whereby it may be pivoted into and out of trimming engagement with the edge or curb of the road. That is to say, the cutting head may be positioned in a first cutter position for trimming material adjacent the supporting surface and in a second cutter position as for transporting the machine from work site to another.

The sweeper means is disposed within the shroud cover relatively behind the cutter means, with respect to the normal direction of travel of the curb and gutter machine. The sweeper means comprises a sweeper motor means mounted on the housing assembly and having a driven sweeper shaft extending therefrom. A brush head is attached to the shaft and reotates therewith to accomplish the actual sweeping operation. In a preferred embodiment, the brush head comprises a brush hub mounted on the sweeper shaft and a plurality of brush elements, preferably formed from braided steel cable, being disposed in a helical pattern around and along the brush hub. Alternatively, the brush hub may comprise an auger, with the brush elements extending from the exposed, helical edge of the auger.

By virtue of these constructions for the sweeper means, as the sweeper motor is actuated and the brush elements caused to rotate, they will tend to move debris away from the curb, or edge, of the road toward the vacuum head means. Adjustment means are also provided between the sweeper shaft and the brush hub whereby the vertical distance between the distal end of each of the brush elements and the supporting surface may be varied. For purposes of protecting both the distal ends of the brush elements and the supporting surface, the preferred adjustment for the sweeper means is such that the distal ends of the brush elements do not actaully engage the supporting surface.

The vacuum head means of the invention communicates with the interior of the housing assembly and is disposed in interconnecting relation between the housing assembly and material collection means attached to the vehicle. In effect, then, trimmed material and roadway debris is swept into the mouth of the vacuum head and moved through a debris conduit into a debris receptacle, preferably mounted on the vehicle. Removal is accomplished by means of a standard vacuum-type motor operatively disposed so as to provide a region of reduced air pressure in the vicinity of the vacuum head and through the debris conduit.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is a top plan view of the curb and gutter machine with the shroud cover removed to show interior detail.

FIG. 2 is a side elevation of the machine shown in FIG. 1 illustrating the placement of the shroud cover in section.

FIG. 3 is a front elevational view of the cutter means.

FIG. 4 is a top plan view of an alternate embodiment for the brush hub.

Similar reference characters refer to similar parts throughout the several views of the drawings.

DETAILED DESCRIPTION

The curb and gutter machine of the present invention is generally indicated as 10 in the views of FIGS. 1 and 10. While machine 10 is primarily intended for use in combination with a vehicle, since the scope of the invention is not limited to any particular vehicle, the view of FIG. 1 only illustrates attachment of machine 10 to a portion of the vehicle frame 12 substantially adjacent one of the vehicle tires 14.

The curb and gutter machine comprises a housing assembly generally indicated as 16 which is attached to vehicle frame 12. The attachment of the housing assembly 16 to the frame 12 is accomplished by a pair of mounting arms 18. As shown in the plan view of FIG. 1, a first end 20 of each of the arms 18 is attached to frame 12 while corresponding second ends 22 are attached to housing frame 24. By virtue of this arrangement of mounting arms 18, the housing assembly 16 may be horizontally-adjusted with respect to the vehicle. Thus, the curb and gutter machine 10 may be properly positioned with respect to the road, or supporting surface, 26 so as to trim curb 28 and to remove debris therefrom.

Referring to the views of FIGS. 1 and 2, it can be seen that the curb and gutter machine 10 further comprises a cutter means generally indicated as 30 and a sweeper means generally indicated as 32 both of which are operatively mounted on frame 24 of the housing assembly 16. With particular regard to the view of FIG. 2, housing assembly 16 further comprises a shroud cover 34 movably attached to housing assembly 16 in substantially enclosing relation to the cutter means 30 and the sweeper means 32. The movable attachment of shroud cover 34 may be accomplished as by a hinge 36 to prevent lifting of shroud 34 by the use of handle 38 disposed on the front of the shroud cover 34. A plurality of wheels 40 are also provided around the bottom of housing frame 24 so as to guide the machine 10 across the supporting surface 26.

The cutter means 30 includes a cutter motor 42 having a driven shaft 44 extending therefrom and a cutting head 46 attached to shaft 44. As best seen in the view of FIGS. 1 and 3, cutter motor 42 is mounted on a plate 48, and plate 48 is attached to pivoting arm 50 such that the entire cutter means 30 may be disposed into an operative first position as shown in FIG. 3, and then swung upwardly, as indicated by double-headed arrow A to a second cutter position for transporting machine 10 from one work site to another. In the operative, first position shown in FIG. 3, it can be seen that cutting head 46 will trim material growing along the outside of curb 28 in soil 53.

One of the unique features of machine 10 is the construction of cutting head 46. Cutting head 46 comprises a plurality of cutting elements 52 which extend radially from the axis of shaft 44 and include distal ends 54. The cutting elements 52 are preferably formed from lengths of braided steel cable, and it is the distal ends 54 which actually accomplish the cutting, or trimming operation as shaft 44 rotates in the direction indicated by arrow B in the view of FIG. 2. Arrow C in FIG. 2 represents the normal direction of travel of the vehicle to which the curb and gutter machine 10 is operatively attached. It should also be noted that the cutter means 30 further comprises adjustable attachment means 56 interposed between shaft 44 and cutting head 46 whereby the vertical distance between distal ends 54 and the material to be trimmed from soil 53 may be varied. This permits utilization of machine 10 with a variety of configurations and sizes of curbs 28.

The sweeper means 32 comprises a sweeper motor 58 mounted on housing frame 24 and having a sweeper shaft 60 extending therefrom and driven by the motor 58. A brush head defined by a brush hub 62 is mounted on sweeper shaft 60 for rotation therewith, and a plurality of brush elements 64 extend radially from the hub 62 and are arranged in a helical pattern around and along the hub 62. Brush element 64 of the sweeper means 32 are preferably formed from braided steel cable in a fashion similar to each of the cutting elements 52. Because the brush elements 64 are disposed in a helical patter along hub 62, when sweeper motor 58 is energized, the brush element 64 will rotate in the direction indicated by arrow D. In the view of FIG. 2 to sweep debris from the road 26, and to direct the debris relatively away from curb 28. As can be seen in the view of FIG. 2, the vertical placement of sweeper means 32 with respect to the surface of road 26 is such that distal ends 66 of the brush element 64 are slightly spaced apart from road 26. This vertical adjustment is accomplished by means of the sweeper adjustable attachment means 68.

The view of FIG. 4 illustrates an alternate embodiment for the hub of sweeper means 32. According to the embodiment shown in FIG. 4, the brush hub is defined by an auger 68. Utilizing auger 68, brush elements 64 (not shown in the view of FIG. 4), would be disposed along the exposed edge 70 of auger 68 as by mechanical clamps or welding, for example. Yet another construction for the brush hub is contemplated wherein the hub is cut into a plurality of longitudinal sections with respect to the axis of shaft 60. Opposing notches are formed in each cylindrical section whereby individual brush elements 64 may be placed into the notches and the cylindrical segments clamped together along shaft 60.

The curb and gutter machine 10 further comprises a vacuum head 72 mounted in fluid communicating relation to housing assembly 16 in receiving relation to debris 74 swept from the surface of road 26 by sweeper means 32. The rear of vacuum head 72 is in communication with debris conduit 76 which is, in turn, in communication with material collection means 78 mounted at a convenient location on the vehicle. The vacuum motor (not shown) of standard construction is disposed in fluid communicating relation with the vacuum head 72 to produce an area of reduced air pressure for the purpose of moving debris 74 from road 26 into the collection means 78.

Accordingly, by virtue of the preferred construction for curb and gutter machine 10, efficient and economical means are provided not only for sweeping a street, but also for trimming, or edging, the side of the street. Because of the adjustable mounting of the cutter means 30, roadways with or without curbs, and roadways with curbs of various sizes and configurations may be trimmed and swept.

It will thus be seen that the objects set forth above, among those made apparent from the preceding description, are efficiently attained. And, since certain changes may be made in the above construction without departing from the scope of the invention, it is intended that all matter contained in the above description or shown in the accompanying drawings shall be interpreted illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A curb and gutter machine used in combination with a vehicle, said machine comprising: a housing assembly attached to the vehicle frame, said housing assembly being adjustable with respect to the vehicle and with respect to the supporting surface along which the vehicle moves; cutter means operatively attached to said housing assembly, said cutter means comprising a cutting head whereby material adjacent the supporting surface may be trimmed; a sweeper means operatively attached to said housing assembly, said sweeper means comprising a brush head whereby material trimmed by said cutting head may be swept; vacuum head means mounted on said housing assembly in receiving relation to material swept from the supporting surface by said sweeper means; and material collection means attached to the vehicle, said vacuum head means being in interconnecting relation between said housing assembly and said material collection means whereby material swept from the supporting surface may pass through said vacuum head means into said material collection means.

2. A curb and gutter machine as in claim 1 wherein said housing assembly comprises mounting arms whereby said assembly may be movably attached to the vehicle frame at a first end of said arms in horizontally-adjustable relation thereto, a housing frame attached to the second end of said arms, a shroud cover movably attached to said housing frame in substantially enclosing relation to said cutter means and said sweeper means; and a plurality of ground wheels attached to said housing frame and extending downwardly therefrom into engagement with the supporting surface.

3. A curb and gutter machine as in claim 1 wherein said cutter means comprises a motor means mounted on said housing assembly, said motor means having a driven shaft extending therefrom, and said cutting head being attached to said shaft.

4. A curb and gutter machine as in claim 3 wherein said cutting head comprises a plurality of cutting elements extending radially from the axis of said shaft, each of said cutting elements including a distal end whereby material adjacent the supporting surface may be trimmed.

5. A curb and gutter machine as in claim 4 wherein each of said cutting elements comprises a length of braided steel cable.

6. A curb and gutter machine as in claim 4 wherein said cutter means is pivotally attached to said housing assembly, whereby said cutter means may be positioned in a first cutter position for trimming material adjacent the supporting surface and in a second cutter position for transporting said machine from one work site to another.

7. A curb and gutter machine as in claim 4 wherein said cutter means further comprises adjustable attachment means interposed between said driven shaft and said cutting head, whereby the vertical distance between said distal ends and the material to be trimmed may be varied.

8. A curb and gutter machine as in claim 1 wherein said sweeper means comprises a sweeper motor means mounted on said housing assembly, said sweeper motor means having a driven sweeper shaft extending therefrom, and said brush head being attached to said shaft.

9. A curb and gutter machine as in claim 8 wherein said brush head comprises a brush hub mounted onto said sweeper shaft and a plurality of brush elements extending radially from the axis of said sweeper shaft, each of said brush elements including a distal end and said brush elements being disposed in a helical pattern around and along said brush hub.

10. A curb and gutter machine as in claim 9 wherein each of said brush elements comprises a length of braided steel cable.

11. A curb and gutter machine as in claim 9 wherein said brush hub comprises an auger, said brush elements extending from the exposed edge of said auger.

12. A curb and gutter machine as in claim 9 wherein said brush hub comprises a cylinder.

13. A curb and gutter machine as in claim 9 wherein said sweeper means further comprises adjustable sweeper attachment means interposed between said sweeper shaft and said brush hub, whereby the vertical distance between said distal ends of said brush elements and the supporting surface may be varied.

* * * * *